US007551883B2

(12) United States Patent
Ide et al.

(10) Patent No.: US 7,551,883 B2
(45) Date of Patent: Jun. 23, 2009

(54) PAPER SEPARATION CLAW HAVING CAVITY AND THROUGH-HOLE

(75) Inventors: Atsushi Ide, Nara (JP); Yasunori Minakuchi, Nara (JP); Noriko Inoue, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/839,615

(22) Filed: Aug. 16, 2007

(65) Prior Publication Data

US 2008/0050154 A1 Feb. 28, 2008

(30) Foreign Application Priority Data

Aug. 24, 2006 (JP) ..... 2006-228188

(51) Int. Cl.
*G03G 15/20* (2006.01)

(52) U.S. Cl. ..... 399/323; 399/322; 399/68; 399/399; 399/320; 399/398; 271/307; 271/308

(58) Field of Classification Search ..... 399/323, 399/322, 398, 399, 320, 68, 307; 271/900, 271/307, 308, 311, 312, 313
See application file for complete search history.

(56) References Cited

U.S. PATENT DOCUMENTS

| | | | | |
|---|---|---|---|---|
| 4,420,152 | A * | 12/1983 | Miyashita | 271/309 |
| 5,589,925 | A * | 12/1996 | Cahill | 399/323 |
| 6,195,523 | B1 * | 2/2001 | Sakai | 399/296 |
| 6,243,556 | B1 * | 6/2001 | Shin | 399/323 |
| 2004/0067080 | A1 * | 4/2004 | Berg et al. | 399/323 |
| 2007/0147912 | A1 * | 6/2007 | Fujii | 399/323 |

FOREIGN PATENT DOCUMENTS

| | | |
|---|---|---|
| JP | 08-054801 | 2/1996 |
| JP | 2000-250351 | 9/2000 |
| JP | 2003-156967 | 5/2003 |

* cited by examiner

*Primary Examiner*—David M Gray
*Assistant Examiner*—G. M. Hyder
(74) *Attorney, Agent, or Firm*—Renner, Otto, Boisselle & Sklar, LLP

(57) ABSTRACT

In one embodiment, the invention provides a paper separation claw disposed near the surface of at least one of fixing rollers that fix toner on recording paper transported in a sandwiched manner, the paper separation claw being disposed in order to separate the recording paper, and a cavity portion that is open facing the surface of the fixing roller is formed in the paper separation claw.

7 Claims, 4 Drawing Sheets

PAPER SEPARATION CLAW HAVING CAVITY AND THROUGH-HOLE

This application claims priority under 35 U.S.C. § 119(a) on Japanese Patent Application No. 2006-228188 filed in Japan on Aug. 24, 2006, the entire contents of which are hereby incorporated by reference.

BACKGROUND OF THE INVENTION

1. Field of the Invention

The present invention relates to a paper separation claw of a fixing apparatus in an electrophotographic image forming apparatus.

2. Description of the Related Art

In this type of fixing apparatus, while transporting recording paper sandwiched in a nip region between a pair of fixing rollers, heat and pressure are applied to the recording paper by the fixing rollers, and thus toner is fixed on the recording paper by hot-melting.

However, it is not the case that all of the toner is firmly affixed on the recording paper by melting due to this sort of fixing process; some amount of toner is transferred to the fixing rollers and affixed there because the fixing rollers have a high surface temperature. Thus, a cleaning apparatus that removes toner remaining on the fixing rollers is ordinarily provided.

A conventional cleaning apparatus removes toner remaining on the fixing rollers using blade cleaning, felt cleaning, or the like, but there is the problem that even when toner remaining on the fixing rollers is removed using such a technique, toner that is temporarily affixed to the blade or felt will return to the fixing rollers.

Consequently, a web cleaning method has been proposed. In this web cleaning method, a web sheet composed of a thin cloth is wrapped around a reel-out roller, and one end of the web sheet is connected to a reel-in roller. The web sheet is reeled out from the reel-out roller and reeled in to the reel-in roller, and during this reeling out and in the web sheet is caused to contact the fixing rollers, thus removing material affixed to the fixing rollers.

On the other hand, it may be the case that the recording paper remains wrapped around the fixing rollers after passing through the nip region and cannot be separated. Thus, as shown in FIG. 5, a separation claw 102 is provided on a fixing roller 101 surface, and the leading edge of the recording paper is peeled away from the fixing roller 101 surface by the separation claw 102. The tip of the separation claw 102 is pointed, and thus easily enters between the leading edge of the recording paper and the fixing roller 101 surface.

Also, in FIG. 5, the face of the separation claw 102 opposing the fixing roller 101 surface is flat, but it may also be the case that this face has a concave shape that follows the fixing roller 101 surface, and thus the separation claw is disposed more closely to the fixing roller 101 surface, allowing the tip of the separation claw 102 to enter between the leading edge of the recording paper and the fixing roller surface.

However, this sort of separation claw needs to be provided in the vicinity of the nip region between the fixing rollers, and so the position where the separation claw is disposed becomes upstream from the cleaning apparatus in the rotation direction of the fixing roller. Thus, the toner remaining on the fixing rollers affixes to the separation claw before being removed, and a large amount of toner affixes to the separation claw.

When this sort of paper separation claw contacts the leading edge of recording paper that has passed through the nip region, toner that has affixed to and accumulated on the separation claw affixes to the leading edge of the recording paper, and thus stains the leading edge of the recording paper.

Also, a clump of the toner remaining on the separation claw may, after becoming large, drop and be affixed to the fixing roller surface. There may be a case in which a large clump of toner on the fixing roller surface cannot be completely removed at once even by a cleaning apparatus, and catches on a peripheral component such as a thermistor for temperature detection provided along the fixing roller surface, causing damage to the peripheral component.

Accordingly, with technology disclosed in JP 2003-156967A, a heater is provided in a separation claw, the separation claw is heated, and even when toner affixes to the separation claw, this toner is immediately melted with heat and returned to the fixing roller surface. This eliminates the problem that the leading edge of the recording paper is stained and a large clump of toner affixes to the fixing roller surface, leading to damage to a peripheral component.

However, when the separation claw is heated by a heater as in the technology of above JP 2003-156967A, it is necessary to provide a sensor for detecting the temperature of the separation claw, and control the temperature of the separation claw, so an increase in the number of components and the difficulty of control are unavoidable.

Also, increased speed of the image forming apparatus is accompanied by an increase in the number of sheets of recording paper processed by the fixing apparatus, so there is an increase in the amount of heat of the fixing rollers, and the power consumption of the image forming apparatus increases to nearly the commercial AC power rating. Thus, it not preferable to have a further increase in the amount of heat due to the heater of the separation claw.

SUMMARY OF THE INVENTION

Consequently, the present invention was made in consideration of the aforementioned conventional problems, and it is an object thereof to provide a paper separation claw capable of removing toner affixed to the separation claw without providing a heater in the separation claw.

In order to address the above problems, the present invention provides a paper separation claw disposed near the surface of at least one of a plurality of fixing rollers that fix toner on recording paper transported in a sandwiched manner, the paper separation claw being disposed in order to separate the recording paper, wherein the paper separation claw has a cavity portion that is open facing the surface of the fixing roller. With this configuration, toner affixed to the surface of the fixing roller enters into the cavity portion of the paper separation claw, and thus the toner does not affix to the leading edge of the recording paper or drop to the surface of the fixing roller.

Also, in the present invention, it is preferable that in the cavity portion, a through-hole is provided that pierces through from an inner face of the cavity portion to an opposite face of the paper separation claw that does not face the surface of the fixing roller, the through-hole being in communication with the cavity portion. With this configuration, the toner that has entered into the cavity portion of the paper separation claw is pushed out to the opposite face of the paper separation claw that does not face the surface of the fixing roller through the through-hole of the paper separation claw, and removed.

Also, in the present invention, the cavity portion may be provided at a location of the paper separation claw that makes contact with the surface of the fixing roller. With this configuration, it is possible for toner that moves from the surface of the fixing roller to the paper separation claw to reliably enter into the cavity portion of the paper separation claw.

Also, in the present invention, it is preferable that the through-hole of the paper separation claw slopes downward in a state in which the paper separation claw has been disposed near the surface of the fixing roller. With this configuration, toner in the cavity portion of the paper separation claw is quickly pushed out through the through-hole by the toner's own weight.

Also, in the present invention, a plurality of the through-holes may be provided. With this configuration, more toner is pushed out.

Also, in the present invention, it is preferable that the length of the through-hole is set such that when toner in a melted state affixed to the surface of the fixing roller has entered into the hollow portion of the paper separation claw, and arrived at the opposite face of the separation claw that does not face the surface of the fixing roller through the through-hole, the toner is in a melted state or a softened state. With this configuration, in the process of the toner in a melted state being pushed out through the through-hole, the temperature of the toner gradually decreases, so that the toner hardens. When the through-hole is too long, the toner hardens within the through-hole, so the through-hole becomes plugged. Therefore, in the present invention, the length of the through-hole is set such that toner that has arrived at the rear face of the separation claw that does not face the surface of the fixing roller is in a melted state or a softened state.

Also, in the present invention, it is preferable that when toner is fixed on recording paper by the plurality of fixing rollers, the ambient temperature near the opposite face of the separation claw that does not face the surface of the fixing roller is set near the softening temperature of the toner. Thus, the toner can be maintained in a melted state or a softened state until the toner is pushed out through the through-hole.

Also, in the present invention, a configuration may be adopted in which when toner in a melted state affixed to the surface of the fixing roller arrives at the opposite face of the paper separation claw that does not face the surface of the fixing roller through the through-hole, the toner accumulates at the opposite face of the paper separation claw, and the toner that has accumulated at the opposite face of the paper separation claw naturally drops due to the toner's own weight. Thus, particular cleaning or the like of the separation claw is not necessary.

DESCRIPTION OF THE PREFERRED EMBODIMENTS

Hereinafter, an embodiment of the present invention will be described in detail with reference to the accompanying drawings.

Figure 1:
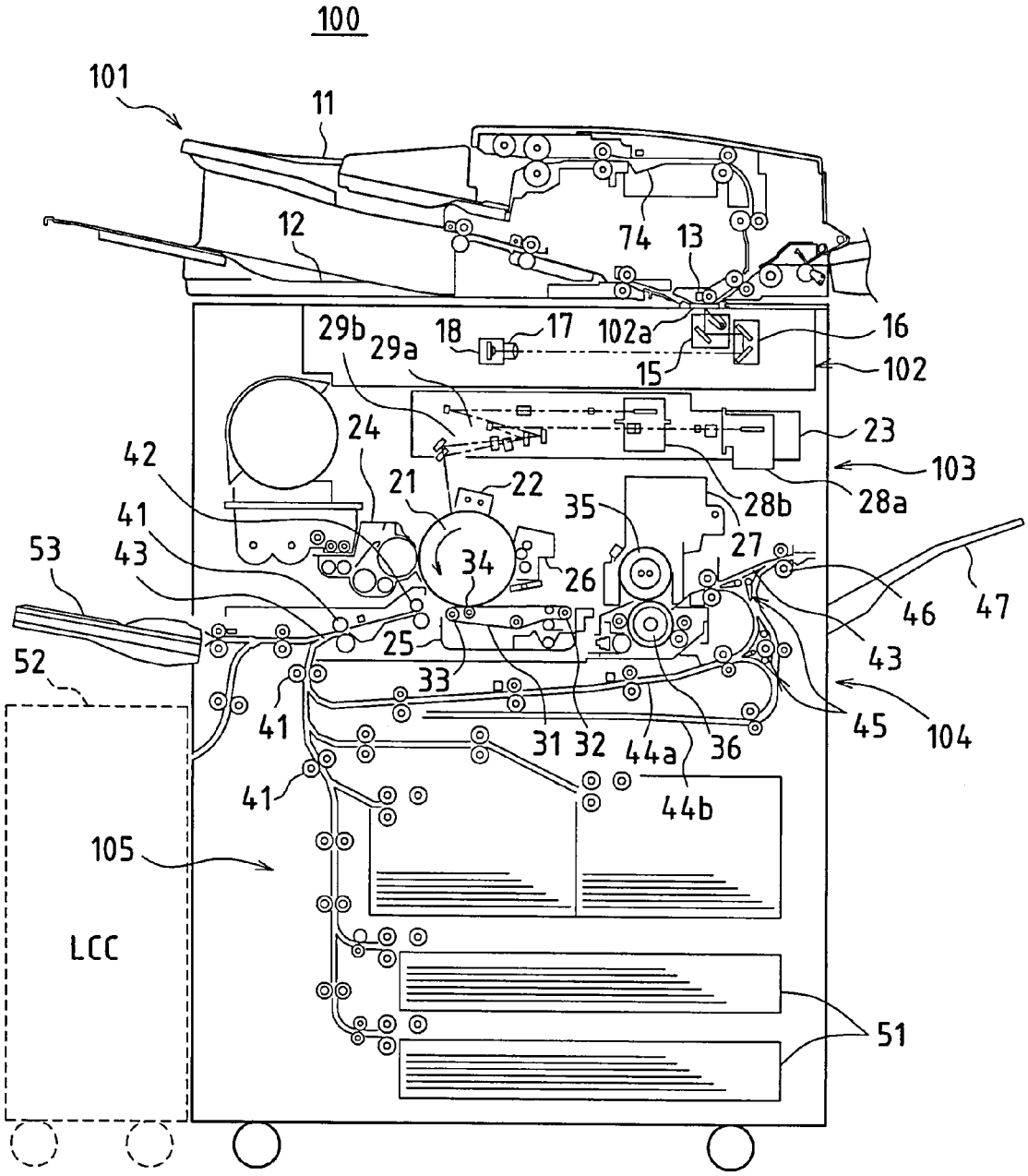
FIG. 1 is a schematic view that shows an image forming apparatus in which an embodiment of fixing apparatus according to the invention has been applied.

FIG. 1 is a schematic view that shows an image forming apparatus provided with a fixing apparatus in which an embodiment of a paper separation claw according to the invention has been applied. An image forming apparatus 100 acquires image data that has been captured from an original paper, or alternatively acquires image data that has been received from outside, and forms a monochrome image expressed by this image data on recording paper. Broadly speaking, the image forming apparatus 100 is configured from an original paper transport portion (automatic document feeder) 101, an image capturing portion 102, a printing portion 103, a recording paper transport portion 104, and a paper feed portion 105.

In the original paper transport portion 101, when at least one sheet of original paper is placed in an original placement tray 11, the original paper is drawn out from the original placement tray 11 and transported page by page, guided to and passed by an original capturing window 102*a* of the image capturing portion 102, and then discharged to a discharge tray 12.

A CIS (Contact Image Sensor) 13 is disposed above the original capturing window 102*a*. When an original paper passes by the original capturing window 102*a*, the CIS 13 repeatedly captures an image of the back face of the original paper in a main scanning direction, and outputs image data that expresses an image of the back face of the original paper.

Also, in the image capturing portion 102, when an original paper passes by the original capturing window 102*a*, the front face of the original paper is exposed to light by a lamp of a first scanning unit 15, reflected light from the front face of the original paper is guided to an imaging lens 17 by mirrors of first and second scanning units 15 and 16, and an image of the front face of the original paper is formed on a CCD (Charge Coupled Device) 18 by the imaging lens 17. The CCD 18 repeatedly captures an image of the front face of the recording paper in the main scanning direction, and outputs image data that expresses an image of the front face of the original paper.

Further, when an original paper has been placed on a glass platen on the upper face of the image capturing portion 102, the first and second scanning units 15 and 16 are moved while maintaining a predetermined speed relationship with each other, the front face of the original paper on the glass platen is exposed to light by the lamp of the first scanning unit 15, reflected light from the front face of the original paper is guided to an imaging lens 17 by the first and second scanning units 15 and 16, and an image of the front face of the original paper is formed on the CCD 18 by the imaging lens 17.

Various image processing is performed by a control circuit of a microcomputer or the like on image data that has been output from the CIS 13 or the CCD 18, and then that data is output to the printing portion 103.

The printing portion 103 records the original expressed by the image data onto paper, and is provided with a photosensitive drum 21, a charging unit 22, an optical writing unit 23, a development unit 24, a transfer unit 25, a cleaning unit 26, a fixing apparatus 27, and the like.

The photosensitive drum 21 rotates in one direction, and the surface of the photosensitive drum 21 is uniformly charged by the charging unit 22 after being cleaned by the cleaning unit 26. The charging unit 22 may be a charger-type charging unit, or may be a roller-type or brush-type charging unit that makes contact with the photosensitive drum 21.

The optical writing unit 23 is a laser scanning unit (LSU) provided with two laser irradiation portions 28*a* and 28*b*, and two mirror groups 29*a* and 29*b*. With the optical writing unit 23, the image data is input, a laser beam corresponding to the image data is emitted from each of the laser irradiation portions 28*a* and 28*b*, these laser beams are irradiated to the photosensitive drum 21 via the mirror groups 29*a* and 29*b*, and the uniformly charged surface of the photosensitive drum 21 is exposed to the light, thus forming an electrostatic latent image on the surface of the photosensitive drum 21.

In the optical writing unit 23, a two-beam system is adopted in which the two laser irradiation portions 28*a* and 28*b* are provided for compatibility with high speed print processing, thus lightening the load that accompanies acceleration of the irradiation timing.

Instead of a laser scanning unit, it is also possible to use an EL write head or LED write head in which light-emitting elements are aligned in an array as the optical write unit 23.

The development unit 24 forms a toner image on the surface of the photosensitive drum 21 by supplying toner to the surface of the photosensitive drum 21 and developing the electrostatic latent image. The transfer unit 25 transfers the toner image on the surface of the photosensitive drum 21 to recording paper that has been transported by the paper transport portion 104. The fixing apparatus 27 applies heat and pressure to the recording paper to fix the toner image on the recording paper. Afterward, the recording paper is further transported to a discharge tray 47 by the paper transport portion 104 and thus discharged. Also, the cleaning unit 26 removes and recovers toner remaining on the surface of the photosensitive drum 21 after development and transfer.

Here, the transfer unit 25 is provided with a transfer belt 31, a drive roller 32, an idler roller 33, an elastic electrically conductive roller 34, and the like, and rotates the transfer belt 31 in a state stretched across the rollers 32 to 34 and other rollers. The transfer belt 31 has a predetermined resistance value (for example, $1\times10^{9}$ to $1\times10^{13}$ Ω/cm), and transports recording paper that has been placed on the surface of the transfer belt 31. The elastic electrically conductive roller 34 is pressed against the surface of the photosensitive drum 21 via the transfer belt 31, and thus presses the recording paper on the transfer belt 31 against the surface of the photosensitive drum 21. An electrical field with an opposite polarity to the electrical charge of the toner image on the surface of the photosensitive drum 21 is applied to the elastic electrically conductive roller 34, and the toner image on the surface of the photosensitive drum 21 is transferred to the recording paper on the transfer belt 31 by the electrical field of opposite polarity. For example, when the toner image has an electrical charge with (−) polarity, an electrical field with (+) polarity is applied to the elastic electrically conductive roller 34.

The fixing unit 27 is provided with a hot roller 35 and a pressure roller 36. An unshown pressure member is disposed at both ends of the pressure roller 36 such that the pressure roller 36 is pressed against the hot roller 35 with a predetermined pressure. When recording paper is transported to a pressure area (referred to as a nip area N) between the hot roller 35 and the pressure roller 36, while recording paper is transported by the rollers 35 and 36, the unfixed toner image on the recording paper is hot melted, and pressure is applied, thus fixing the toner image on the recording paper.

The paper transport portion 104 is provided with a plurality of pairs of transport rollers 41 for transporting recording paper, a pair of registration rollers 42, a transport path 43, reverse transport paths 44*a* and 44*b*, a plurality of branch catches 45, and a pair of discharge rollers 46.

In the transport path 43, recording paper is received from the paper feed portion 105 and transported until the leading end of the recording paper reaches the registration rollers 42. Because at this time the registration rollers 42 have been temporarily stopped, the leading end of the recording paper reaches and makes contact with the registration rollers 42, and so the paper bows. Due to the elastic force of the bowed recording paper, the leading end of the recording paper is aligned parallel to the registration rollers 42. Afterward, rotation of the registration rollers 42 is started, the recording paper is transported to the transfer unit 25 of the printing portion 103 by the registration rollers 42, and the recording paper is further transported to the discharge tray 47 by the discharge rollers 46.

Stoppage and rotation of the registration rollers 42 is performed by on/off switching of a clutch between the registration rollers 42 and a drive shaft, and on/off switching of a motor serving as a drive source of the registration rollers 42.

Also, when recording an image also to the back face of recording paper, the branch catches 45 are selectively switched, the recording paper is guided from the transport path 43 into the reverse transport path 44*b*, transport of the recording paper is temporarily stopped, again the branch catches 45 are selectively switched, and the recording paper is guided from the reverse transport path 44*b* into the reverse transport path 44*a*, thus reversing the front and back of the recording paper, and then the recording paper is returned to the registration rollers 42 of the transport path 43 via the reverse transport path 44*a*.

This sort of transport of recording paper is referred to as switchback transport, and with switchback transport, it is possible to reverse the front and back of the recording paper, and at the same time switch the leading end and the trailing end of the recording paper. Accordingly, when the recording paper is reversed and then caused to return, the trailing end of the recording paper makes contact with the registration rollers 42, the trailing end of the recording paper is aligned parallel to the registration rollers 42, the recording paper is transported to the transfer unit 25 of the printing portion 103 by the registration rollers 42 beginning with the trailing end of the recording paper, printing is performed on the back face of the recording paper, the unfixed toner image on the back face of the recording paper is hot melted and pressure is applied by the nip area between the rollers 35 and 36 of the fixing unit 27, thus fixing the toner image on the back face of the recording paper, and afterward the recording paper is transported to the discharge tray 47 by the discharge rollers 46.

In the transport path 43 and the reverse transport paths 44*a* and 44*b*, sensors that detect the position of the recording paper or the like are disposed at various locations, and based on the position of the recording paper detected by the sensors, driving of the transport rollers and the registration rollers is controlled, and transport and positioning of the recording paper are performed.

The paper feed portion 105 is provided with a plurality of paper feed trays 51. Recording paper is accumulated in the paper feed trays 51, and they are provided toward the bottom of the image forming apparatus 100. Also, the paper feed trays 51 are provided with a pickup roller or the like for drawing out recording paper sheet by sheet, and feed the drawn out recording paper to the transport path 43 of the paper transport portion 104.

Because an object of the image forming apparatus 100 is high speed print processing, a capacity capable of storing 500 to 1500 sheets of recording paper of a determinate size is insured for each paper feed tray 51.

Also, provided in a side face of the image forming apparatus 100 is a large capacity cassette (LCC) 52 capable of storing a large quantity of a plurality of types of recording paper, and a manual feed tray 53 for supplying mainly recording paper of an indeterminate size.

The discharge tray 47 is disposed in the side face of the side opposite to the manual feed tray 53. In this configuration it is also possible to dispose a recording paper post-processing apparatus (that performs stapling, punch processing, or the like) or a plurality of levels of discharge trays as options instead of the discharge tray 47.

In this sort of image forming apparatus 100, image processing speed is accelerated and thus usability is improved. For example, when using A4-standard recording paper, the recording paper transport speed is set to 70 sheets/minute (process speed 350 mm/sec).

In the fixing apparatus 27, when the recording paper transport speed or the process speed becomes fast, there is a tendency that an adequate amount of heat cannot be applied to recording paper that passes through the nip region between the hot roller 35 and the pressure roller 36, or that the surface temperature of the rollers 35 and 36 decreases, and when this is neglected, poor fixing of the toner image on the recording paper occurs.

Therefore, in the fixing apparatus 27, a heater is built into both of the rollers 35 and 36, and the rollers 35 and 36 are heated. Also, an external heating unit 48 for heating the hot roller 35 from outside is provided, the hot roller 35 is directly heated by the external heating unit 48, and the hot roller 36 also is indirectly heated by heat conduction between the rollers 35 and 36. Thus, a reduction in the surface temperature of the rollers 35 and 36 is suppressed, so that the surface temperature of the rollers 35 and 36 is maintained at a prescribed fixing temperature.

Figure 2:
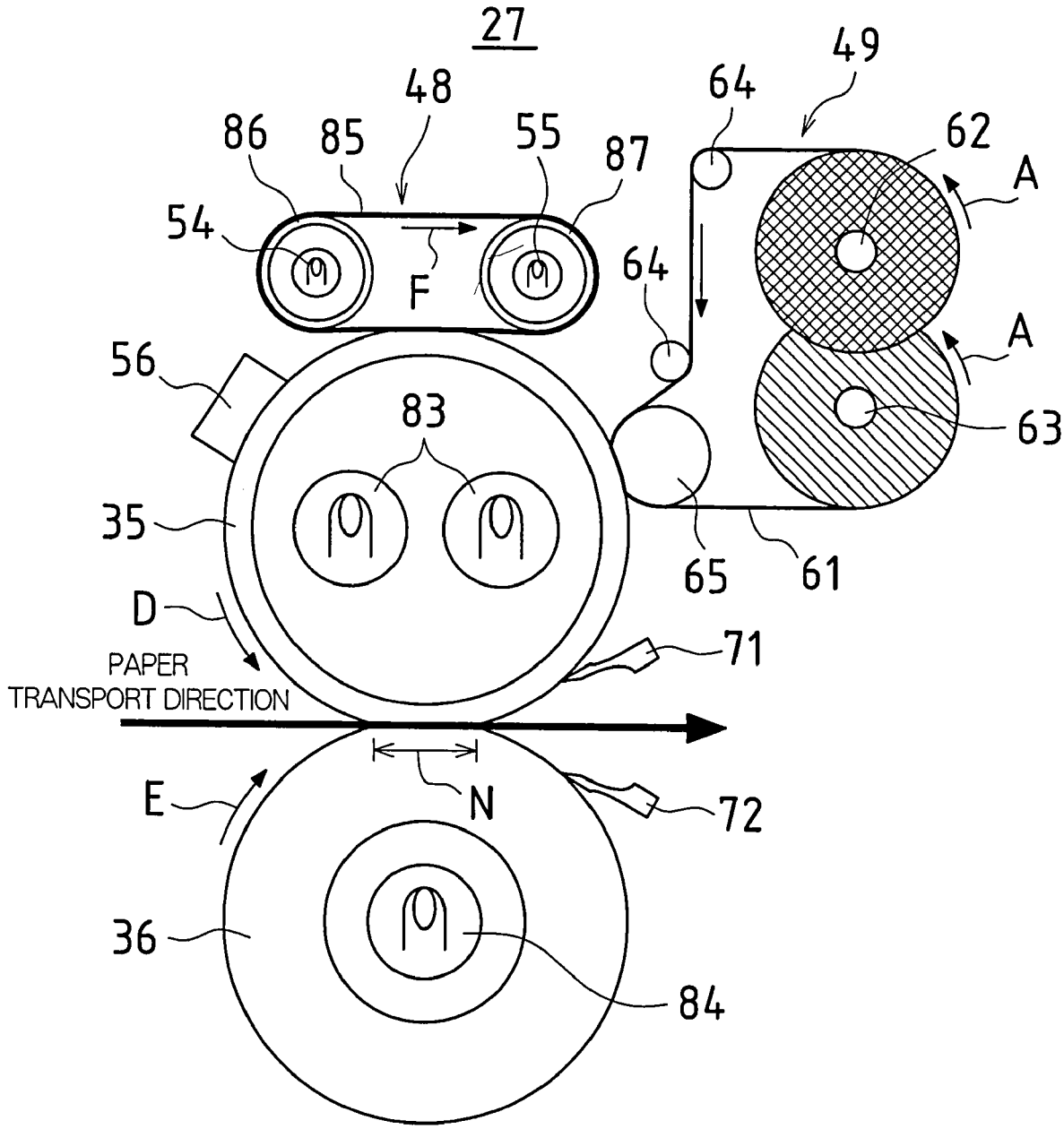
FIG. 2 is a cross-sectional view that schematically shows the fixing apparatus according to this embodiment viewed from the side.

FIG. 2 is a cross-sectional view that schematically shows the fixing apparatus 27 according to this embodiment viewed from the side. The fixing apparatus 27 is provided with the hot roller 35, the pressure roller 36, an external heating unit 48 that heats the hot roller 35 from outside, a cleaning apparatus 49 that removes toner affixed to the surface of the hot roller 35, and respective separation claws 71 and 72 provided on the surface of the rollers 35 and 36.

The rollers 35 and 36 press against each other with a predetermined pressing force (for example, 600 N), and a nip region N is formed between the rollers 35 and 36. The length of the nip region N (length in the direction of rotation of the rollers 35 and 36) is set to, for example, 9 mm. The rollers 35 and 36 rotate while heated to a prescribed fixing temperature (for example, 180° C.), thus hot-melting a toner image on recording paper P that passes through the nip region N.

The hot roller 35 has a three-layer structure in which an elastic layer is provided on the outer surface of a metal core, and a separation layer is formed on the outer surface of the elastic layer. For example, a metal such as iron, stainless steel, aluminum, or copper, or an alloy or the like thereof, is used in the metal core. Also, silicon rubber is used in the elastic layer, and a fluorocarbon resin such as PFA (a copolymer of tetrafluoroethylene and perfluoroalkylvinyl ether) or PTFE (polytetrafluoroethylene) is used in the separation layer.

A heat lamp (halogen lamp) 83 heat source that heats the roller 35 is provided inside the hot roller 35 (inside the metal core).

Like the hot roller 35, the pressure roller 36 has a three-layer structure including a metal core composed of a metal such as iron, stainless steel, aluminum, or copper, or an alloy or the like thereof, an elastic layer of silicon rubber or the like on the surface of the metal core, and a separation layer of PFA, PTFE, or the like on the elastic layer.

Also, a heat lamp 84 that heats the roller 36 is provided inside the pressure roller 36 (inside the metal core).

The heat lamps 83 and 84 of the rollers 35 and 36 are controlled on-off and radiate infrared rays when on to heat the respective rollers 35 and 36. The rollers 35 and 36 are heated from their inside, and thus their surface is uniformly heated.

The external heating unit 48 is provided with an endless heating belt 85 and a pair of external hot rollers 86 and 87. The endless heating belt 85 is stretched across the external hot rollers 86 and 87.

The endless heating belt 85 has a two layer configuration in which a separation layer composed of a synthetic resin material with excellent heat-resistance and separability properties (for example, a fluorocarbon resin such as PFA or PTFE) is formed on the surface of a hollow cylindrical base material composed of a heat-resistant resin such as a polyimide or a metal material such as stainless steel or nickel. In order to reduce uneven tension of the endless heating belt 85, a coating of fluorocarbon resin or the like is applied on the inner surface of the belt base material.

The external hot rollers 86 and 87 are made of a hollow cylindrical metal core material composed of aluminum or iron-based material or the like. In order to reduce uneven tension of the endless heating belt 85, a coating of fluorocarbon resin or the like is applied on the inner surface of the metal core material.

Also, respective heat lamps 54 and 55 that heat the rollers 86 and 87 are provided inside the external hot rollers 86 and 87. The heat lamps 54 and 55 are controlled on-off and radiate infrared rays when on to heat the respective rollers 86 and 87. The rollers 35 and 36 are heated from their inside, and thus their surface is uniformly heated. Also, heat is conducted from the surface of the rollers 86 and 87 to the endless heating belt 85, and when the endless heating belt 85 rotates along with the hot rollers 86 and 87, the entire endless heating belt 85 is uniformly heated.

A thermistor 56 is disposed near the surface of the hot roller 35, and the surface temperature of the hot roller 35 is detected by the thermistor 56.

Here, the hot roller 35 is rotated in the direction indicated by arrow D by driving rotation of a shaft of the hot roller 35 by a motor and a power transmission mechanism or the like (not shown). The pressure roller 36 rotates idly in the direction indicated by arrow E, due to being pressed against by the hot roller 35. Also, the endless heating belt 85 of the external heating unit 48 rotates idly in the direction indicated by arrow F when in contact with the hot roller 35. Thus, the hot roller 35, the pressure roller 36, and the endless heating belt 85 rotate in synchronization with each other.

Also, based on the surface temperature of the hot roller 35 detected by the thermistor 56, the heat lamps 83 and 84 of the hot roller 35 and the pressure roller 36, and the heat lamps 54 and 55 of the external hot rollers 86 and 87, are controlled on-off to adjust the surface temperature of the hot roller 35 and the pressure roller 36, and the surface temperature of the endless heating belt 85. Thus, the surface temperature of each roller is appropriately controlled, so that a toner image can be reliably fixed on recording paper.

On the other hand, when the number of sheets of print processing is large, the total amount of remaining toner affixed to the hot roller 35 is also large, and so it is not possible to reliably remove toner remaining on the hot roller 35 by blade cleaning, felt cleaning, or the like. Therefore, a cleaning apparatus 49 is applied.

The cleaning apparatus 49 is provided with a feed-out roller 62 around which is wrapped a web sheet 61 composed of a thin cloth (with a thickness of about 100 μm) impregnated with oil (silicon oil), a reel-in roller 63 connected to the leading edge of the web sheet 61, a plurality of tension rollers 64 that provide tension to the web sheet 61 in a transport path of the web sheet 61 from the feed-out roller 62 to the reel-in roller 63, and a pressure roller 65 that presses the web sheet 61 against the hot roller 35 between the feed-out roller 62 and the reel-in roller 63. The cleaning apparatus 49 presses the web sheet 61 against the surface of the hot roller 35 with the pressure roller 65 and removes remaining toner affixed to the surface of the hot roller 35 by wiping that toner away.

The web sheet 61 is pressed against the surface of the hot roller 35 by the pressure roller 65 in a nip region between the pressure roller 65 and the hot roller 35. When the web sheet 61 portion of the nip region is stained by the toner remaining on the surface of the hot roller 35 and so removal of the remaining toner by the web sheet 61 portion is difficult, by rotating the feed-out roller 62 and the reel-in roller 63 a fixed amount, the web sheet 61 is fed out a fixed amount from the feed-out roller 62 to the reel-in roller 63, thus renewing the web sheet 61 portion of the nip region, and so it is possible for the remaining toner to be removed by the new web sheet 61 portion.

At a level that a fixed amount of toner is consumed, it is presumed that removal of remaining toner by the web sheet 61 portion of the nip region has become difficult, and so the feed-out roller 62 and the reel-in roller 63 are rotated a fixed amount to renew the web sheet 61 portion of the nip region. Accordingly, the feed-out roller 62 and the reel-in roller 63 are intermittently rotationally driven.

Toner also affixes to the surface of the hot roller 36. However, the toner on the surface of the hot roller 36 is removed by the cleaning apparatus 49 after moving to the surface of the hot roller 35 in the nip region N.

Next, the separation claws 71 and 72 are disposed downstream from the nip region N in the direction of rotation of the respective rollers 35 and 36. The vicinity of the base of the separation claws 71 and 72 is swingably or elastically supported, and the tip end side of the separation claws 71 and 72 is biased to the side of the respective rollers 35 and 36 by an elastic member so that the vicinity of the tip end of the separation claws 71 and 72 is lightly pressed against the surface of the respective rollers 35 and 36. When recording paper has wrapped around either of the rollers 35 and 36, the leading edge of the recording paper is separated by the tip end of either of the separation claws 71 and 72, and thus the recording paper is separated from the roller surface. In this manner recording paper jams are prevented.

However, because the separation claw 71 is provided downstream from the cleaning apparatus 49 in the direction of rotation of the hot roller 35, a part of the toner on the surface of the hot roller 35 affixes to the separation claw 71 before the toner on the surface of the hot roller 35 is removed by the cleaning apparatus 49. Also, a part of the toner on the surface of the pressure roller 36 affixes to the separation claw 72.

When such toner affixed to the separation claws 71 and 72 is ignored, the amount of toner affixed to the separation claws 71 and 72 becomes large, and when the separation claws 71 and 72 contact the leading edge of recording paper that has passed through the nip region N, the toner on the separation claws 71 and 72 moves to the leading edge of the recording paper, thus staining the recording paper, or alternatively, a clump of accumulated toner fixed on the separation claws 71 and 72 drops and affixes to the surface of the hot roller 35 or the pressure roller 36, thus staining the recording paper. This may cause damage to a peripheral component provided along the surface of the roller, such as the thermistor 56.

Figure 3:
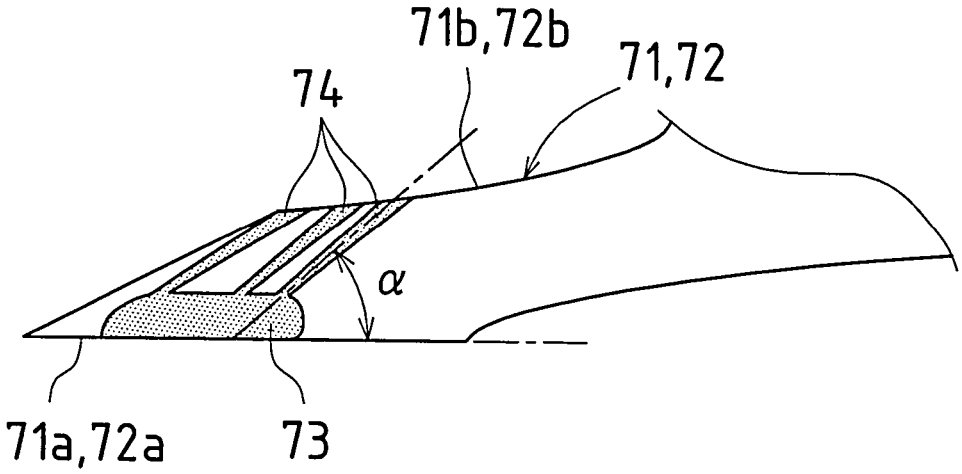
FIG. 3 is a side view that shows a separation claw in the fixing apparatus in FIG. 2.

Consequently, in the present embodiment, as shown in FIG. 3, a cavity portion 73 that is open facing the surface of the rollers 35 and 36 is formed in the separation claws 71 and 72, and a plurality of through-holes 74 that pierce through from the cavity portion 73 to rear faces 71*b* and 72*b* of the separation claws 71 and 72 are formed in the separation claws 71 and 72.

Figure 4:
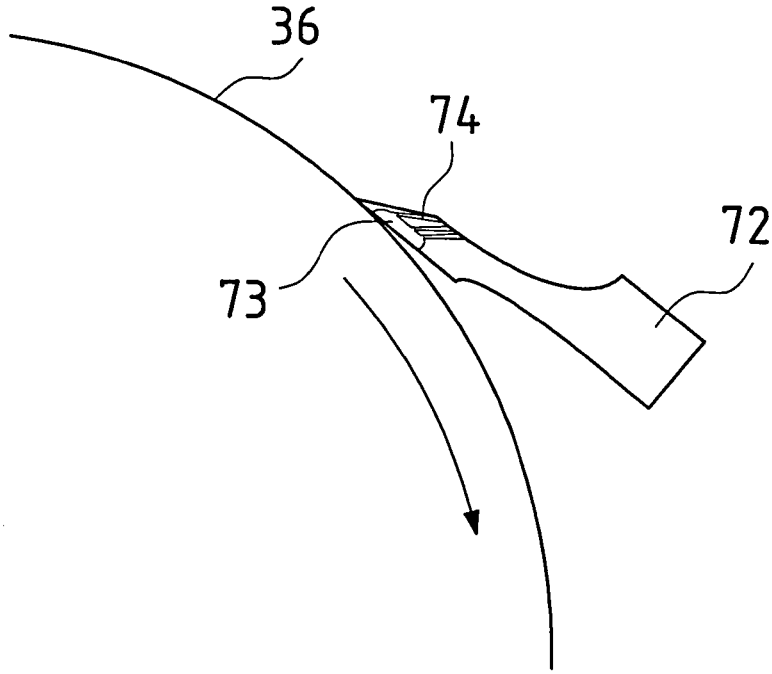
FIG. 4 is a side view that shows a state in which the separation claw in FIG. 3 has been disposed on a hot roller surface.
Figure 5:
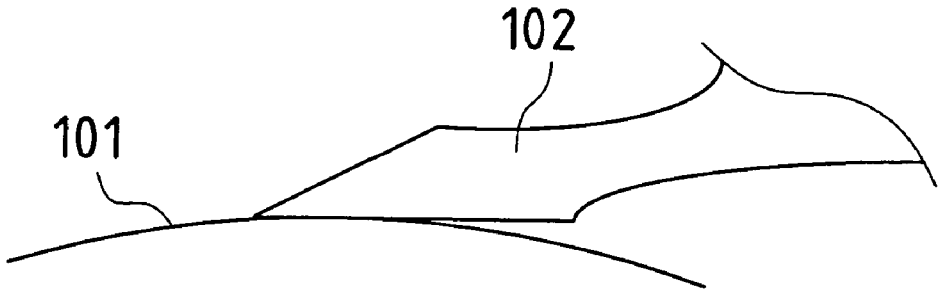
FIG.5 Prior Art
FIG. 5 is a side view that shows a conventional separation claw.

A slope angle α (shown in FIG. 3) of the through-holes 74 relative to a front face 72*a* of the separation claw 72 is set such that the through-holes 74 slope downward when the separation claw 72 is disposed along the surface of the pressure roller 36 as shown in FIG. 4. Likewise, when the separation claw 71 is disposed along the surface of the hot roller 35, the through-holes 74 slope downward.

In a case in which such separation claws 71 and 72 are provided, when the toner affixed to the surface of the rollers 35 and 36 moves to the side of the front faces 71*a* and 72*a* of the separation claws 71 and 72, this toner enters into the cavity portion 73 of the separation claws 71 and 72, and is held there. Accordingly, the toner is unlikely to affix to the outside of the separation claws 71 and 72, and so the toner does not move from the separation claws 71 and 72 to the leading edge of the recording paper and affix there, and thus the recording paper is not stained. Also, the toner held in the hollow portion 73 of the separation claws 71 and 72 does not drop to the surface of the rollers 35 and 36.

Also, toner that has entered the cavity portion 73 of the separation claws 71 and 72 passes through the through-holes 74, and is pushed out to the rear faces 71*b* and 72*b* of the separation claws 71 and 72 that do not face the surface of the rollers 35 and 36. Thus, toner that has entered the cavity portion 73 of the separation claws 71 and 72 is successively removed.

Further, as stated above, the through-holes 74 of the separation claws 71 and 72 slope downward in a state in which the separation claws 71 and 72 are disposed on the surface of the rollers 35 and 36. Thus, the toner in the cavity portion 73 of the separation claws 71 and 72 is quickly pushed out through the through-holes 74 by the toner's own weight.

The length of the through-holes 74 is set such that when toner in a melted state has arrived at the rear faces 71*b* and 72*b* of the separation claws 71 and 72 through the through-holes 74, the toner is in a melted or a softened state. Here, in the process of the toner in a melted state being pushed out through the through-holes 74, the temperature of the toner gradually decreases, so that the toner hardens. When the through-holes 74 are too long, the toner hardens within the through-holes 74, so the through-holes 74 become plugged. Consequently, a configuration is adopted in which the through-holes 74 are appropriately short, so that toner in a melted state that has arrived at the rear faces 71*b* and 72*b* of the separation claws 71 and 72 is in a melted state or a softened state, without hardening within the through-holes 74.

Further, when toner is fixed on recording paper by the rollers 35 and 36, the ambient temperature near the rear faces 71*b* and 72*b* of the separation claws 71 and 72 is set near the softening temperature of the toner. For example, the ambient temperature near the rear faces 71*b* and 72*b* of the separation claws 71 and 72 can be adjusted by appropriately setting a ventilation path and an amount of air ventilation provided by a ventilation fan of the image forming apparatus 100. Thus, the toner can be maintained in a melted state or a softened state until the toner is pushed out through the through-holes 74.

Also, a configuration is adopted such that when toner that has been pushed out through the through-holes 74 affixes and accumulates at the rear faces 7*b* and 72*b* of the separation claws 71 and 72, thus becoming a clump of toner, the clump of toner naturally drops due to its own weight. For example, a smooth face is adopted for the rear faces 71*b* and 72*b* of the separation claws 71 and 72, such that it is easy for the clump of toner to naturally drop. Thus, particular cleaning or the like of the separation claws 71 and 72 is not necessary.

The present invention is not limited to the above embodiment, and can be modified in various ways. For example, a cleaning apparatus that removes toner on the surface of the pressure roller 36 may also be provided on the pressure roller 36 side. Also, the heat lamp of the pressure roller 36 may be omitted. In this case, application of the present invention is quite preferable, because, there is a tendency for the temperature of the separation claw 72 of the pressure roller 36 to fall, so that toner on the surface of the pressure roller 36 moves to the separation claw 72, where the toner hardens and easily affixes.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A paper separation claw disposed near the surface of at least one of a plurality of fixing rollers that fix toner on recording paper transported in a sandwiched manner, the paper separation claw being disposed in order to separate the recording paper, wherein the paper separation claw having a cavity portion that is open facing the surface of the fixing roller, to hold removed toner on a face facing the fixing roller and a through-hole that pierces through from an inner face of the cavity portion to an opposite face of the paper separation claw that does not face the surface of the fixing roller, and the through-hole being a channel to push out the toner to the face being an opposite side of the face facing the fixing roller.

2. The paper separation claw according to claim 1, wherein the cavity portion is provided at a location of the paper separation claw that makes contact with the surface of the fixing roller.

3. The paper separation claw according to claim 1, wherein the through-hole of the paper separation claw slopes downward in a state in which the paper separation claw has been disposed near the surface of the fixing roller.

4. The paper separation claw according to claim 1, wherein there are a plurality of the through-holes.

5. The paper separation claw according to claim 1, wherein a length of the through-hole is set such that when toner in a melted state affixed to the surface of the fixing roller has entered into the cavity portion of the paper separation claw, and arrived at the opposite face of the paper separation claw that does not face the surface of the fixing roller through the through-hole, the toner is in a melted state or a softened state.

6. The paper separation claw according to claim 1, wherein when toner is fixed on recording paper by the plurality of fixing rollers, an ambient temperature near the opposite face of the paper separation claw that does not face the surface of the fixing roller is set near a softening temperature of the toner.

7. The paper separation claw according to claim 1, wherein when toner in a melted state affixed to the surface of the fixing roller arrives at the opposite face of the paper separation claw that does not face the surface of the fixing roller through the through-hole, the toner accumulates at the opposite face of the paper separation claw, and the toner that has accumulated at the opposite face of the paper separation claw naturally drops due to the toner's own weight.

* * * * *